US010099831B2

(12) United States Patent
Egli

(10) Patent No.: US 10,099,831 B2
(45) Date of Patent: Oct. 16, 2018

(54) STORAGE SYSTEM

(76) Inventor: LaRece Egli, Bellevue, ID (US)

( * ) Notice: Subject to any disclaimer, the term of this patent is extended or adjusted under 35 U.S.C. 154(b) by 0 days.

(21) Appl. No.: 13/553,510

(22) Filed: Jul. 19, 2012

(65) Prior Publication Data

US 2014/0021091 A1 Jan. 23, 2014

(51) Int. Cl.

| | |
|---|---|
| ***A45C 11/04*** | (2006.01) |
| ***B65D 65/38*** | (2006.01) |
| ***A45C 7/00*** | (2006.01) |
| ***A45C 11/16*** | (2006.01) |
| ***A45C 11/26*** | (2006.01) |
| ***A45C 13/12*** | (2006.01) |
| ***A45F 3/04*** | (2006.01) |

(52) U.S. Cl.

CPC ..... *B65D 65/38* (2013.01); *A45C 7/0077* (2013.01); *A45C 7/0086* (2013.01); *A45C 11/16* (2013.01); *A45C 11/26* (2013.01); *A45C 13/123* (2013.01); *A45F 3/04* (2013.01)

(58) Field of Classification Search

CPC ..... B65D 65/38; A45C 7/0077; A45C 7/0086; A45C 11/16; A45C 11/26; A45C 13/123; A45F 3/04

USPC ..... 190/125, 109, 110; 150/105, 104, 107, 150/127; 224/223; 24/164; 206/6.1, 206/278, 553, 495, 205, 223, 558, 561, 206/479, 756, 315.11, 736

See application file for complete search history.

(56) References Cited

U.S. PATENT DOCUMENTS

| | | | | |
|---|---|---|---|---|
| 3,900,060 | A * | 8/1975 | Shammas | 206/6.1 |
| 4,350,194 | A * | 9/1982 | Brown | 206/315.5 |
| 6,250,470 | B1 * | 6/2001 | MacKenzie | 206/579 |
| 6,371,285 | B1 * | 4/2002 | DuBois | 206/6.1 |
| 7,171,707 | B2 * | 2/2007 | Landay | 5/413 R |
| 2005/0056669 | A1 * | 3/2005 | Lavelle | 224/153 |
| 2006/0196744 | A1 * | 9/2006 | Greiner | 190/110 |
| 2009/0184011 | A1 * | 7/2009 | Krakauer | 206/278 |
| 2009/0288744 | A1 * | 11/2009 | Moshirisfahini et al. | 150/104 |
| 2009/0314219 | A1 * | 12/2009 | Bryson | 119/496 |

* cited by examiner

*Primary Examiner* — Anthony Stashick
*Assistant Examiner* — James M Van Buskirk
(74) *Attorney, Agent, or Firm* — Scott D. Swanson; Shaver & Swanson, LLP

(57) ABSTRACT

What is disclosed is a storage and transport system for storage and transport objects such as jewelry or any other objects to be stored or carried. In a preferred embodiment, the carrier is a roll having a series of interchangeable attachments. In a further preferred embodiment, the interchangeable attachments are capable of being layered. The system further discloses a system in which attachments are interchangeable between various items or articles.

13 Claims, 11 Drawing Sheets

STORAGE SYSTEM

TECHNICAL FIELD

The presently disclosed and claimed inventive concept(s) generally relates to apparatuses for a storage and transportation, and more particularly to a transport and storage system including detachable and interchangeable storage attachments.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

Storage and transportation accessories are an important aspect for storage and transport of a wide variety of items. For example, jewelry rolls, or other roll up type organizers, are a popular way to transport jewelry and other items. Jewelry rolls come in a variety of shapes and sizes. Typically jewelry rolls provide a fixed mechanism for attaching jewelry or other items to the roll in an open position and subsequently rolled or folded for protecting the jewelry (or other object) when the roll is rolled or folded for transport or storage. This provides a convenient, protective way to transport jewelry or other items. What is needed is an interchangeable system rather than fixed mechanisms allowing the user to interchange the types of attachments and connectors thus providing flexibility to the user of an interchangeable storage system. Such an interchangeable system allows items to be moved within and between storage or transport accessories.

What is disclosed is an interchangeable system in which various articles have interchangeable components and/or layerable components. These components can be attached by a variety of connectors or fasteners, including a preferred double stud snap fastener. With these snap fasteners, multiple fasteners can be used in such a way that they can be layered on top of one another in order to allow for a layering of articles (also called attachments). This can include, for example, a GPS case that can be made to be interchangeable between a first item, such as a belt, and a second item, for example, a backpack. Further, a belt, tote bag or purse can be made such that there are patterns of fasteners that allow for a variety of different articles and attachments to be attached and interchanged between the articles, including the first item, such as a backpack, and a second item, such as a purse. In the system the goods are made to be non-identical, i.e. in an embodiment of the invention the first good is a backpack and the second good is a purse. This allows for interchangeability of attachments between these items creating a system of interchangeable items between a multitude of goods. Thus, a consumer could own several non-identical goods, such as a purse, a backpack, and a belt and interchange, for example, a GPS or phone carrying case between each of the goods because each of the goods has an attachment system allowing for the interchangeability of the GPS carrying case between the different items. A second example could be a cell phone case that is made to have connectors that connect onto the primary item, such as a belt, backpack, or purse. These can be made to include articles such as backpacks, cell phone carriers, belts, tote bags, purses and a wide variety of other applications. Items such as a backpack or a purse may have a snap fastener pattern on the outer part of the backpack or on the inner part of the backpack or on both. The articles such as a backpack can have a snap pattern within an internal or external pocket such as on the inside of the front pocket. The materials can have a combination of fasteners such as belt loops on a GPS carrying case as well as snaps in the event the user wishes to attach the GPS carrying case onto a backpack or similar article. A square loop fastener or similar fastener can be utilized that allows for a backpack or other type of article to attach a device that does not contain the interchangeable connector pattern. A swivel snap hook attachment can be used to attach objects that do not have the standard interchangeable fasteners. This is a standard attachment found in the industry. There is a wide variety of different attachments that can be utilized to attach objects to the storage system. This use is illustrative and not meant to be limiting, as a wide variety of attachments and attachment systems can be used.

What is further disclosed as an article that can be used in the interchangeable system is an adjustable storage roll system for storage and transportation having a base pattern of fasteners on the body of the article that can then accept attachments that support any combination of fasteners on an article that hosts the system. In the preferred embodiment, the connectors are configured such that a variety of attachments can be attached to each connector. These attachments are interchangeable such that attachments configured to hold a variety of objects can be attached to the adjustable storage system via the same connectors. The connectors are configured as such that the attachments can be moved in location on the back to provide a user with a wide variety of attachment positions and mechanisms such that the attachments can be configured to the user's preference. Hence, for example, a cell phone carry case can be attached to the storage system via the same connectors that a map carrying case would be attached or a GPS carrying case would be attached.

The base article can have a securing mechanism for releasably securing the system in the closed position. The back can be made out of material selected from, but not limited to, material such as leather, cotton, duck, waxed cotton, nylon, neoprene, polyester, rubber coated tech fabrics, Gortex® (or other waterproof laminates or similar waterproof and/or breathable material), microfiber materials, felted materials, net materials, Lycra® (generically elastane) materials, or other similar material. The connectors in the preferred embodiment can include snaps, buttons, rivets, turn fasteners, one way lift fasteners, screws, buckles, hooks, clips, grommets, rings, ties, laces, hook and loop fabric and elastic, although other types of connectors can be used, including fasteners that allow for layering of attachments. The various types of interchangeable attachments that can be used include, but are not limited to, sleeves and socks for individual pieces, boxes, pillow rolls, envelopes for individual pieces or multiple pieces, wrist watch holders, molded earring straps, pouches, pockets, envelopes, straps, cases, sleeves, covers, and closures.

In a further embodiment, the connectors or fasteners that connect the attachment to the primary article (such as the storage roll back) are made such that the attachments can be layered on top of other attachments in a stacked (or layered system). In this way, multiple attachments can be attached to one another to increase the capability and storage of the system. This can be made such that either individual connectors are configured for layering such that a connector could attach an attachment to a base article and subsequently a second attachment to the first attachment via the same connector, thus layering connectors and thus attachments one on top of the other. Alternatively, attachments could have a second series of connectors, thus allowing the attachment to connect to the primary article via a first set of attachments and to connect to the secondary article via a second set of attachments or function as a closure.

In a preferred embodiment, the connectors are placed in rows, in which the connectors can be spaced either at an equal distance from neighboring connectors or at a variable distance. This allows for the interchangeability of attachments such that the attachments can be connected at different locations within the interchangeable storage system. Also disclosed is a layerable fastener that uses a first piece having at least a stud or male connector and a second piece featuring a female connector compatible with the male stud. Either of these pieces can have either a second male or female connector, thus allowing further connectors to attach or the connector could feature a terminal end.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE ILLUSTRATED EMBODIMENTS

Figure 1:
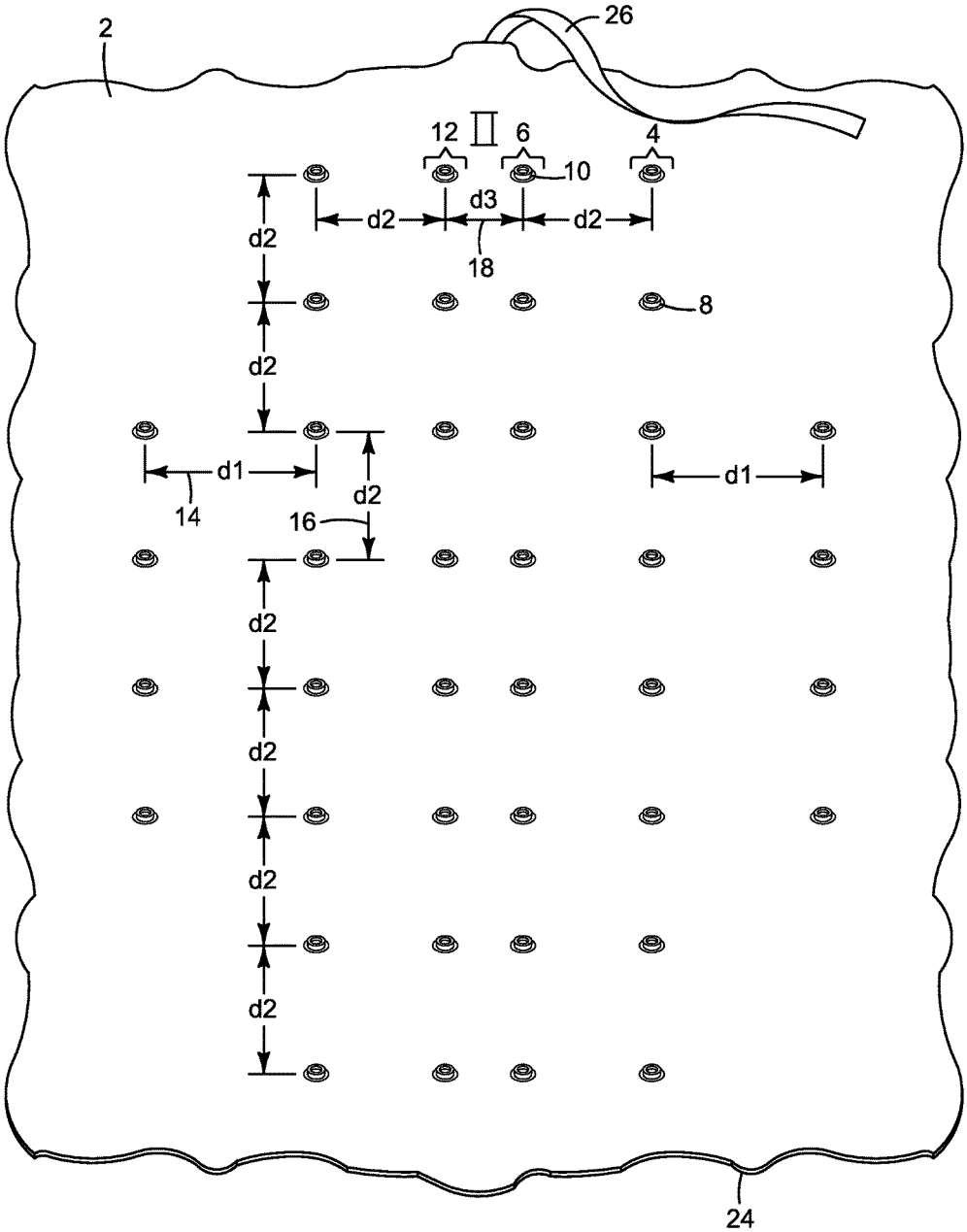
FIG. 1 illustrates a top view of a preferred embodiment of a first adjustable storage system or first item being an open storage roll without any attachments attached to the storage roll.

In the following description and in the figures, like elements are identified with like reference numerals.

The use of "e.g.," "etc," and "or" indicates non-exclusive alternatives without limitation unless otherwise noted.

The use of "including" means "including, but not limited to," unless otherwise noted.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIG. 1 illustrates is a top view of a of an adjustable storage system in an open position. The depicted storage roll can be considered to be an example of a first adjustable storage system or first item in an adjustable storage system. The storage roll has a back or flat portion to that has ribbon 26 for securing the storage roll when the storage roll is in a closed or rolled position. The back has an assortment of connector mechanisms 12, 6, 4 that are use to connectors that attach objects to the storage roll for storage and/or transportation. These connectors can come in a variety of useful mechanisms. This includes snaps, buttons, rivets, turn fasteners, one way lift fasteners, screws, buckles, hooks, clips, grommets, rings, ties, laces, hook and loop fabric, and elastic, for example.

In preferred embodiment, the attachments are configured such that the attachments can be attached with a variety of fasteners, which can be interchangeable. For example, an attachment could be fastened to a fastener 4, fastener 6 or fastener 12, depending on the users' preference. Fasteners 4, 6, 12 can be separated by a variety of uneven distances or the distances can be the same. For example, d2 can be equal to d3, or it can be in different distance. In a preferred embodiment, this distance is equal thusly to a greater interchangeability of attachments.

In FIG. 1, d1 is referred to as reference number 14 whereas d2 is referred to as reference number 16. In a preferred embodiment, the outer edge of the back can be stylized. However, the designer prefers, in the illustrated embodiment, the outer edge 24, is configured to have a rougher appearance.

The adjustable storage system 2 depicted in FIG. 1 can come in a variety of fabrics, including leather, cotton, duck, waxed cotton, nylon, neoprene, polyester, rubber coded tech fabrics, Gortex® (or other waterproof laminates, waterproof materials and/or breathable materials, microfiber materials, felted materials, net materials or Lycra® (elastene) materials, for example.

The adjustable storage system depicted in FIG. 1 could also be made out of aluminum, stainless steel, bronze, silver or gold, for example, or a variety of other components. The outer portion could me made of a composition of materials, depending on the designers' preference. The adjustable storage system 2 could also be made out of a plastic, provided that the plastic is foldable or rollable. The adjustable storage system 2 can be made out of any combination of material. Similarly The adjustable storage system 2 can be covered with similar material, a more flexible material, or a less flexible material.

In a preferred embodiment, the adjustable storage system is designed to secure a variety of objects including jewelry, but a wide variety of articles or objects may be placed in the adjustable storage system. The adjustable storage system could be presented in a variety of sizes, and could be used, for example, to hold a variety of products, including makeup, toiletries, keys, watches, cash, credit cards, passports, airline tickets, or other valuables during travel. Specialty attachments for each object would allow them to be attached to the base storage roll and arranged in a multitude of ways. Meanwhile, other specialty attachments could be used in accessories for, iPads, laptops, shoes, etc. that would allow them to be transported inside of other base items such as luggage, purses, messenger bags, etc. Additionally this flexible system of attachments will allow objects to be attached securely to the exterior of articles that feature the base pattern of fasteners. The flexibility of featuring a universal system of fasteners on multiple base items will allow users to customize their travel accessories to suit specific transportation needs because attachments and objects attached to these attachments can freely be moved inside of each transportation article, to the inside of a second article or attached to the outside of any article that host an external base pattern of fasteners. External attachments can easily support attaching iPhones, GPS devices, solar charging accessories to belts, backpacks, messenger bags etc. This system of fasteners could also be used on base articles such as luggage, or incorporated into a messenger or bicycle bag, or could be used for a valet to hold a variety of objects. Further, the adjustable storage system could be made with shoulder holsters. Further, the adjustable storage system could be made to be compatible with luggage, backpacks, shoulder holsters, belts, purses, tote bags, and/or messenger bags or other items.

Figure 2:
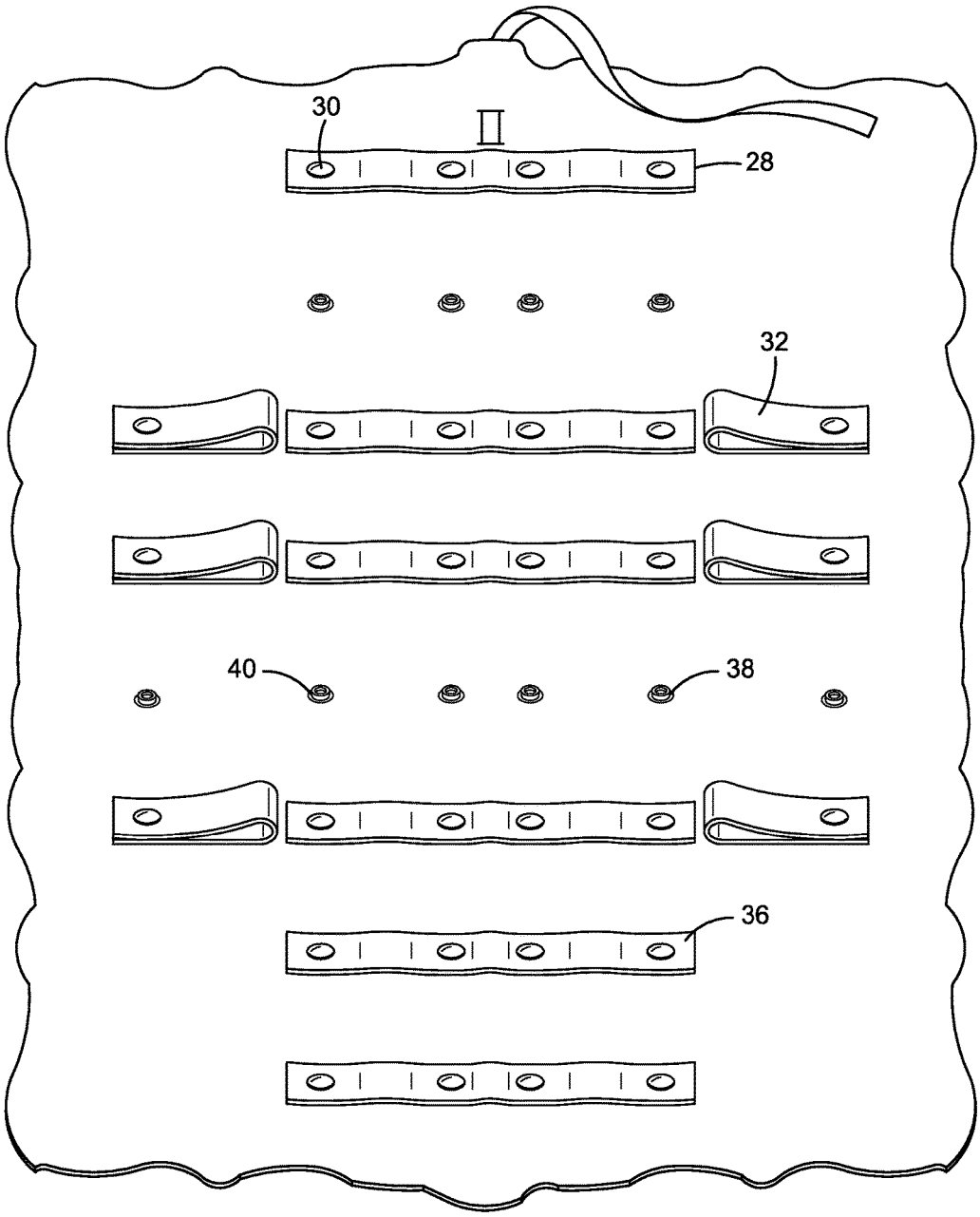
FIG. 2 illustrates a top view of a preferred embodiment of an open storage roll with a series of attachments attached to the storage roll.

FIG. 2 illustrates a preferred embodiment of an open or flat adjustable storage system having a variety of specialty attachments that host the fasteners. Two fasteners without attachments are illustrated at 38 and 40. A fastener 30 is attached to a second fastener (not illustrated) connecting storage roll accessory 28 to the storage roll. Similarly, storage roll accessory 32 is attached on to the adjustable storage system. FIG. 2 illustrates that a variety of different attachments can be attached to the adjustable storage system, via the fasteners. Attachment 32 is connectable to storage roll fastener 38 or 40, illustrating the interchangeability of the fasteners. Similarly, there can be multiples of the same attachments 28, 36 or sub attachments as illustrated, or the attachments can be provided in a variety of different shapes and/or sizes.

Figure 3:
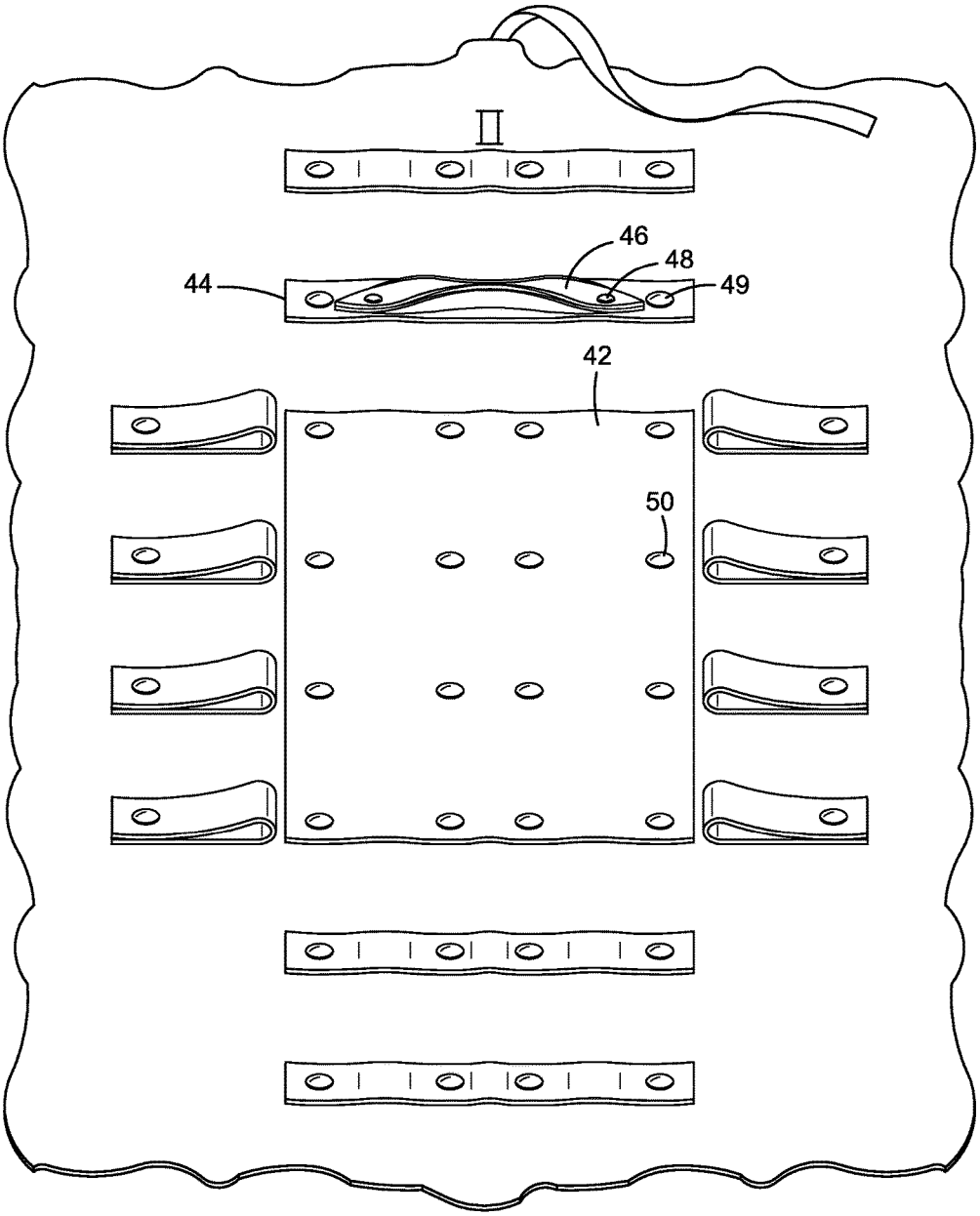
FIG. 3 illustrates a top view of a preferred embodiment of an open storage roll with a series of attachments including layered attachments.

FIG. 3 illustrates another variety of sizes and interchangeability of attachments in a preferred embodiment. As illustrated, attachment 42 is attached proximate to the center of the adjustable storage system. Attachment 42 is attached by the fasteners 50 to fasteners on the storage roll. The attachments are constructed such that attachments can be layered 44, 46, 48. The fasteners of the multi-layer attachments can be constructed and selected such that the various attachments are staggered as illustrated in FIG. 3, or the fasteners can be configured to be layered directly on top of one another when in series.

Figure 4:
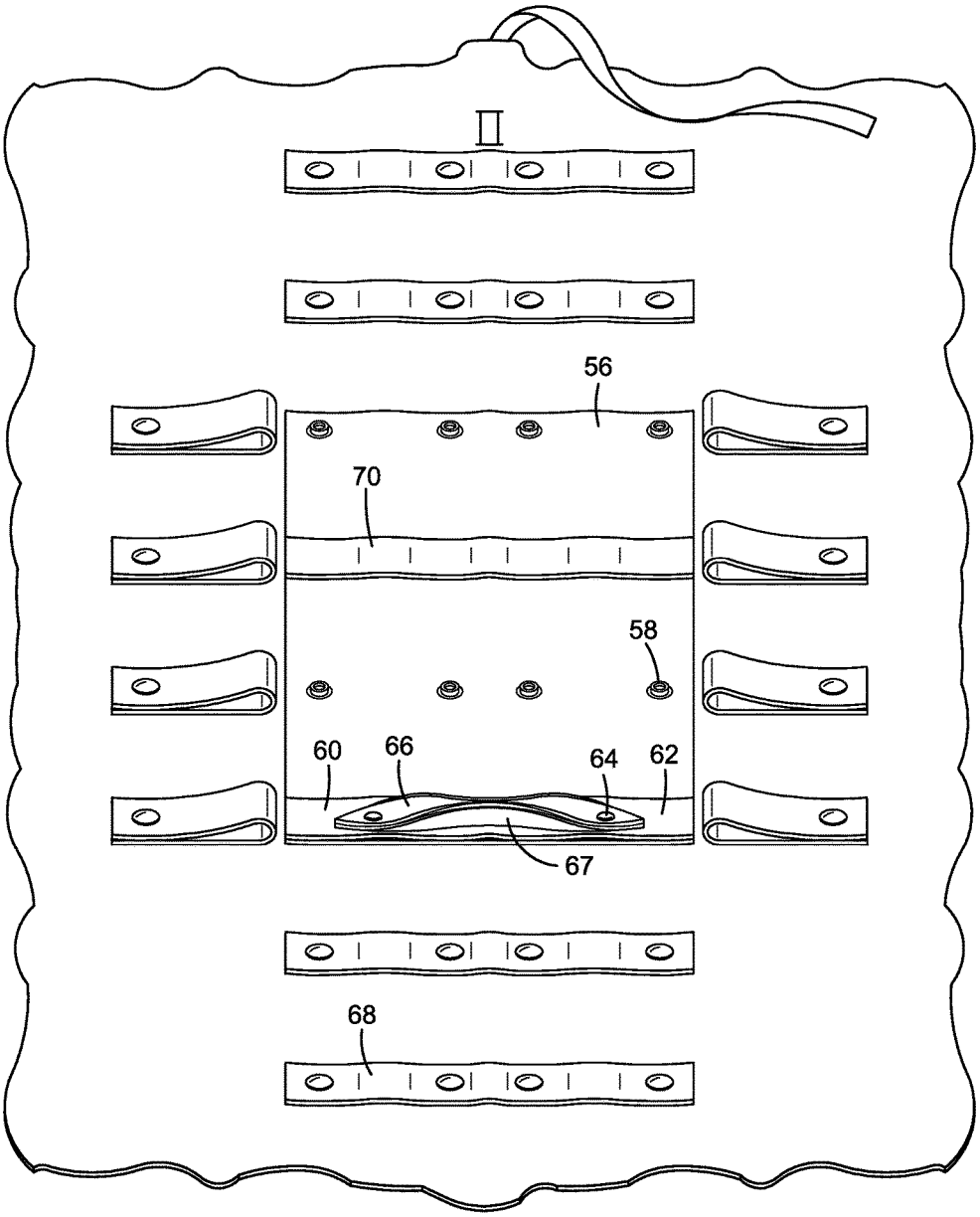
FIG. 4 illustrates a top view of a preferred embodiment of an open storage roll with a series of layered attachments.

FIG. 4 illustrates the layering effects possible for attachments compatible with the interchangeable system. In a preferred embodiment, attachment 66 is layered directly on to attachment 67. The connectors or snaps in attachment 67 are not illustrated as they are beneath the snaps as illustrated in attachment 64. Connectors may be attached at locations 60 and 62 in order to add further fasteners onto the attachment 67. Attachment mechanism on the center attachment 56 illustrates a further attachment mechanism. Reference number 68 illustrates another attachment fastened to the storage roll. Because this system does not rely on fixed attachments, a singular attachments can be configured to function in a variety of ways that previously required several individual attachment components. These attachments could include, for example, a pillow attachment, sleeves and socks for individual pieces, boxes pillow rolls and individual pieces, envelopes for individual pieces, wrist watch holders, molded earring straps, pouches, pockets, and envelopes. The attachment in the illustrated embodiment are for jewelry connection and include, for example, a variety of necklace straps, necklace shields, earring straps, bracelet straps, utility straps or enclosure/utility straps. Because of the flexible nature of this system, each of these specialty attachments will remain free to be used in multiple configurations for multiple functions throughout the storage roll shown or another base article that hosts the system of fasteners.

Figure 5:
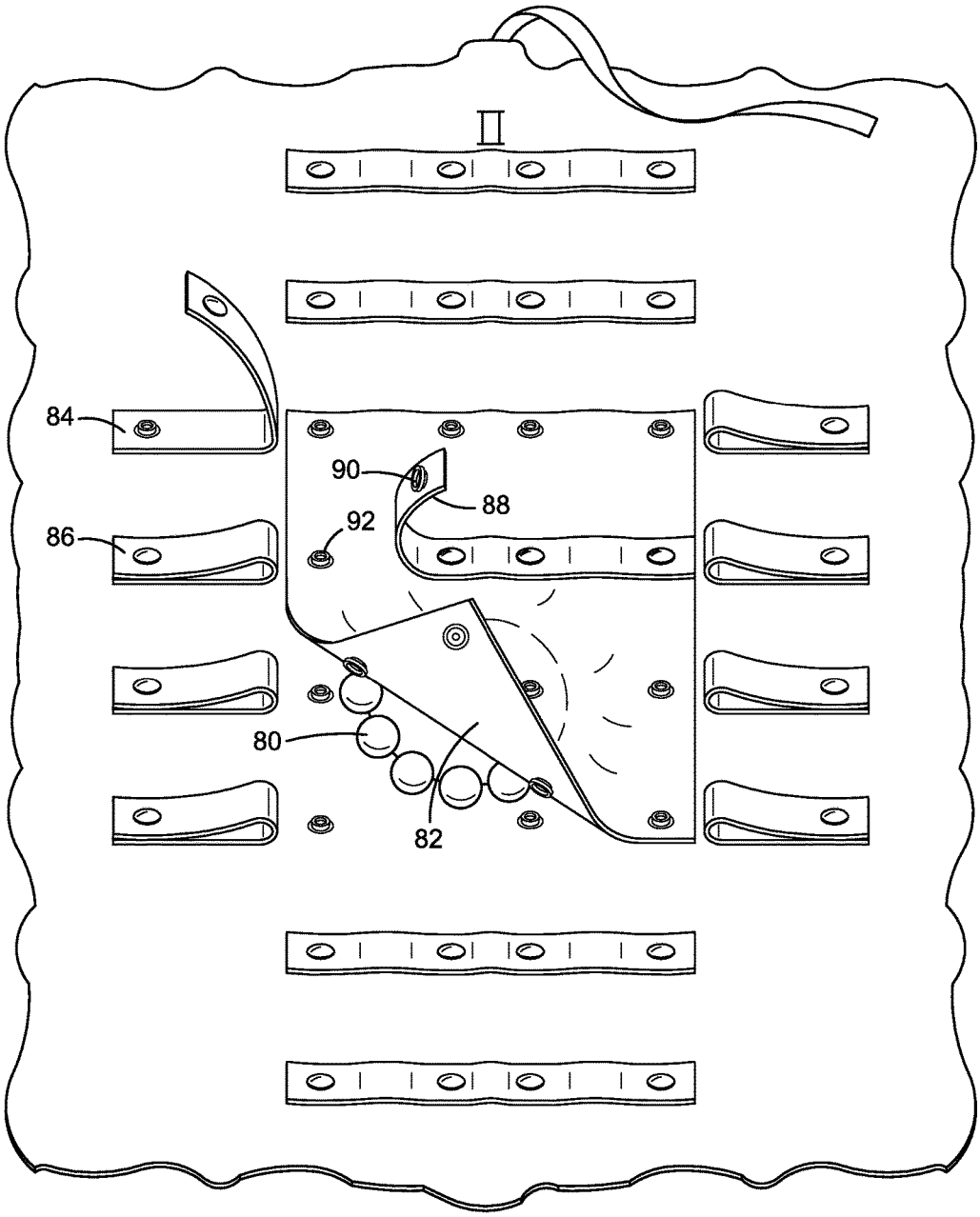
FIG. 5 illustrates a top view of a preferred embodiment of an open storage roll with a series of attachments including jewelry attached to the storage roll.

FIG. 5 illustrates that a variety of attachments 84, 88, 82 can be used in association with the adjustable storage system in a preferred embodiment. The connectors 90, 92 illustrate that second attachment 88 is layerable or stackable on first attachment 82 to provide a multiple layered system to hold jewelry, or other objects, and can include a necklace 80. Attachments 84, 86 illustrate an open attachment 84 that is configured to accept an object for storage or transport. The object is placed within the attachment, which is configured to be attached to the article as illustrated by attachment 86.

Figure 6:
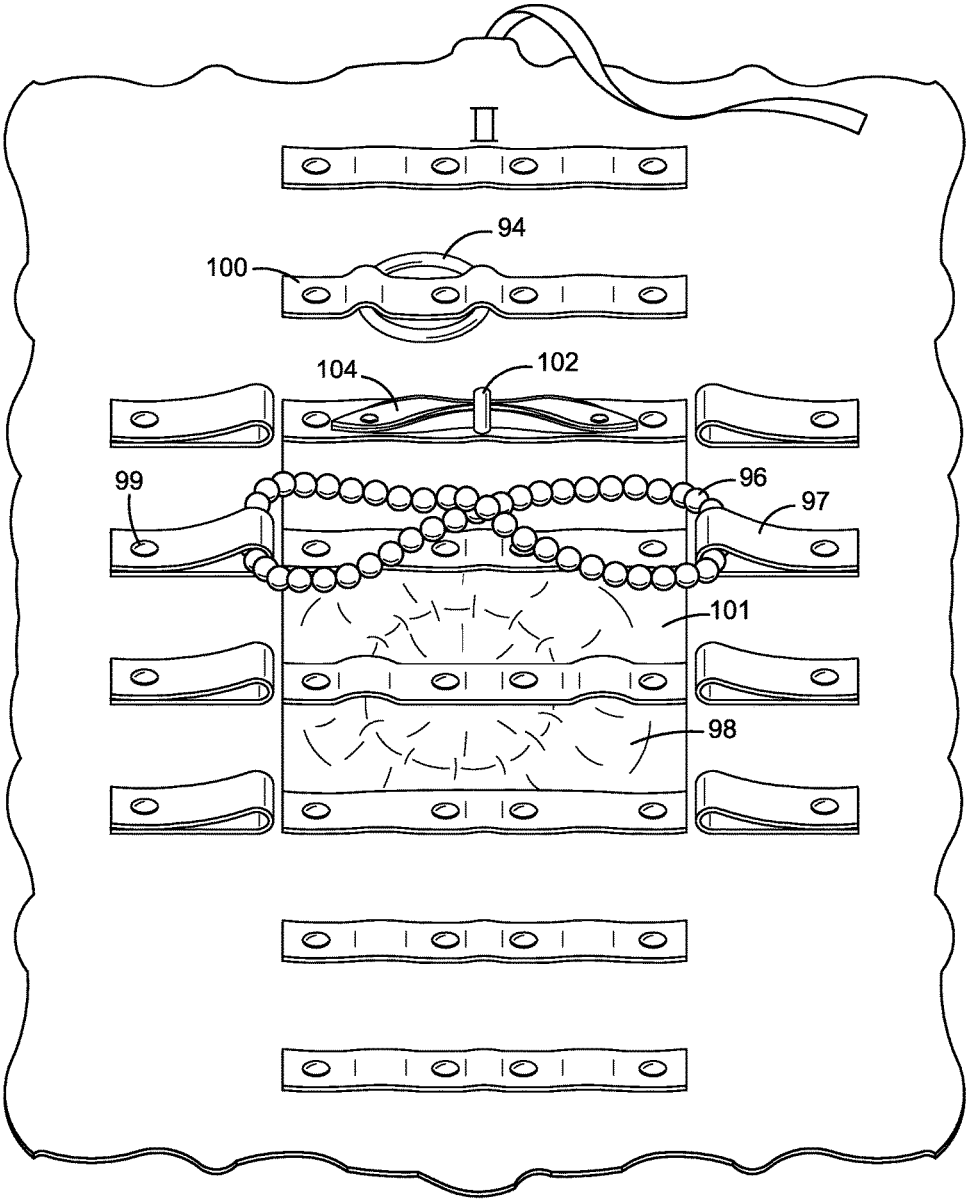
FIG. 6 illustrates a top view of a preferred embodiment of an open storage roll with a series of layered attachments attaching several pieces of jewelry to the storage roll.

FIG. 6 illustrates pieces of jewelry attached to the adjustable storage system. As illustrated, a bracelet 94 is retained with attachment 100, which is connected to the storage roll. Attachment 104 is retaining a ring 102 into the adjustable storage system as well. Necklace 96 is being held by necklace holders 97 and 99. The center attachment 101 is holding a piece of jewelry 98 beneath center attachment 101. Central attachment covers the object and protects it from banging into other objects retained in the storage mechanism.

Figure 7:
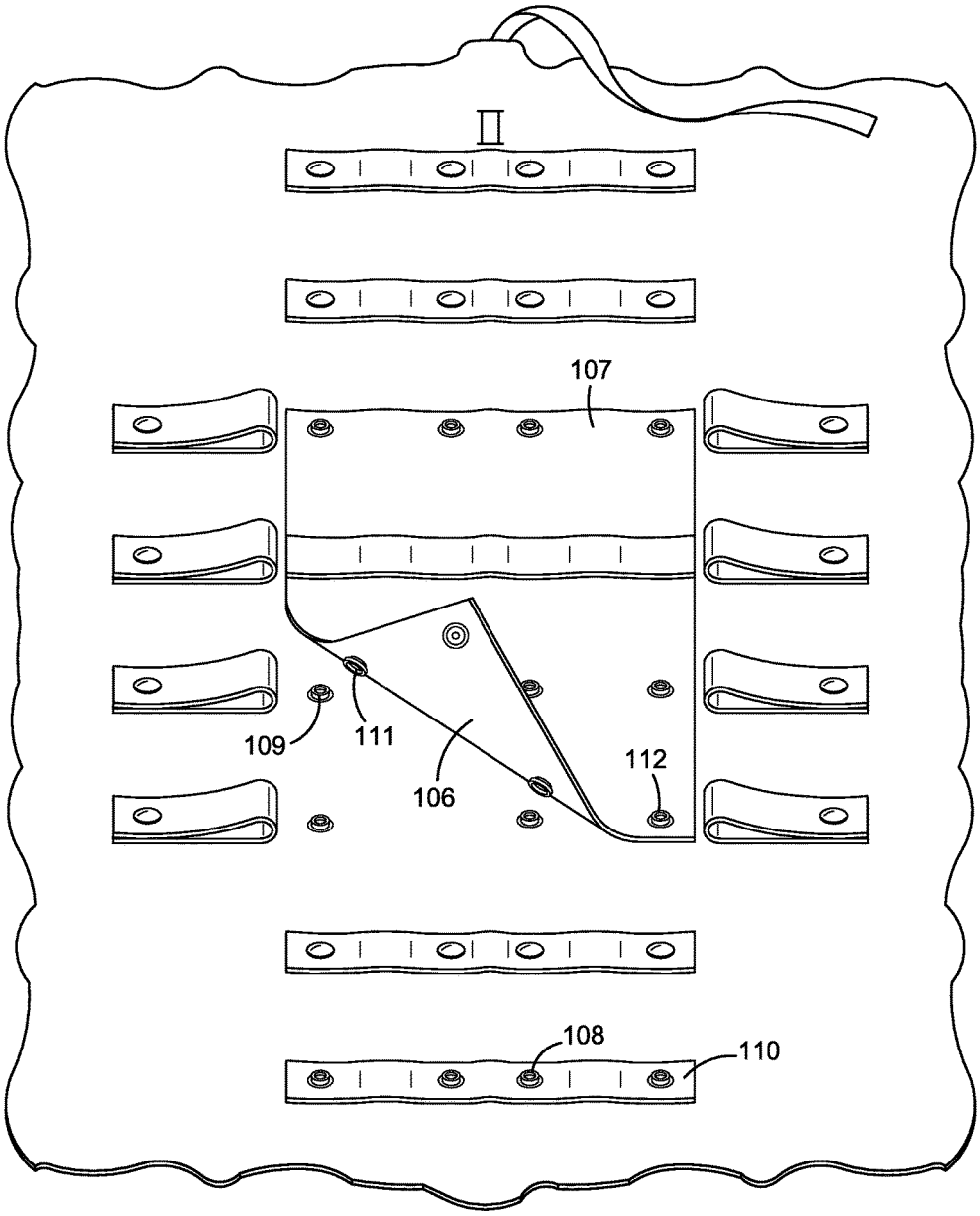
FIG. 7 illustrates a preferred embodiment of an open storage roll with the options of layering attachments.

FIG. 7 illustrates center piece 107 is attached to the adjustable storage system. Center piece 107 is attached to the storage roll via attachments 109, 111. When attached to center attachment, center attachment corner 106 of the center jewelry attachment 107, is attached to the storage unit via snaps, i.e., 111, 109.

The attachments can be selected such that the attachments are layerable fasteners or connectors, as illustrated by 112 and 108. Reference number 108 illustrates a snap fastener on top of a second snap fastener (not shown) that is attaching attachment 110 to the storage roll.

Figure 8:
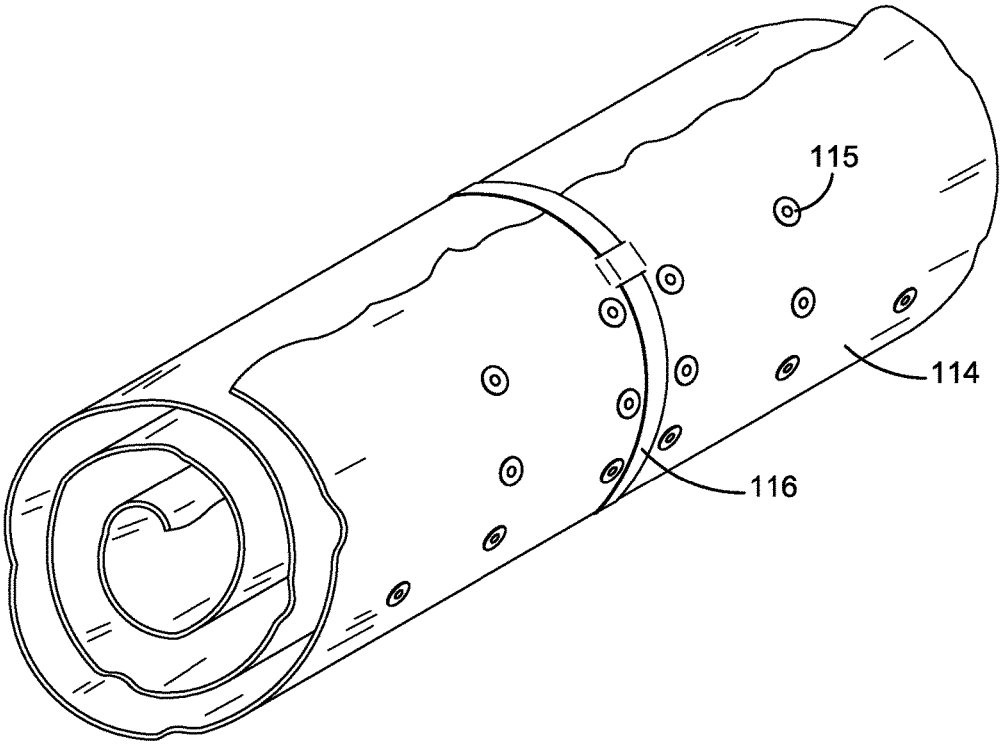
FIG. 8 illustrates a perspective view of a preferred embodiment of a closed storage roll.

FIG. 8 illustrates a preferred embodiment of a adjustable storage system or similar rollable storage/transport device in a rolled or closed formation. While this is a preferred embodiment, the layer system of the adjustable storage system can come in a variety of formats, including a foldable system. adjustable storage system 114 is rolled and secured in a roll secured by ribbon 116. The bottom of the connectors 115 is also illustrated. These bottom connectors could also be employed with double stud fasteners to become a closure or yet another layer in a stackable system.

Figure 9:
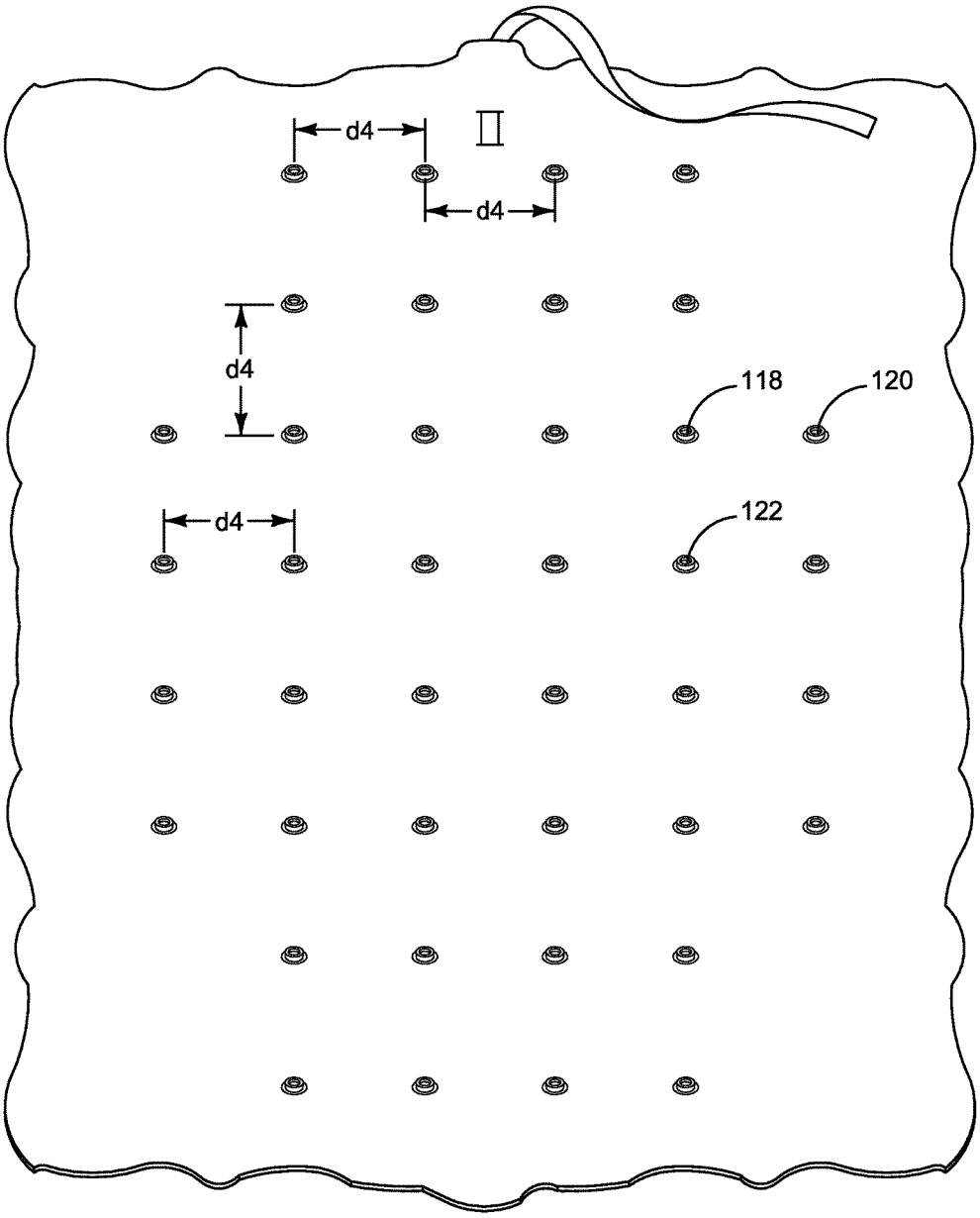
FIG. 9 illustrates a preferred embodiment of an open storage roll without any attached attachments.

FIG. 9 illustrates a preferred embodiment of a rollable or foldable storage/transport system. In the depicted embodiment, connectors 118, 120, 122 are positioned at distances such that attachments are interchangeable between varying positions on the back. The depicted embodiment the connectors are positioned uniform distance d4 apart such that any attachment having connectors compatible with the attachments shown in FIG. 9 (i.e., 118, 120, 122) can be positioned anywhere on the back of the storage unit (for example on a storage roll) thus allowing for interchangeability of attachments on the individual roll or on other items, such as on a backpack, shoulder holster, messenger bag, luggage, belt, purse, tote bag, or any other article with the same connector pattern.

Figure 10:
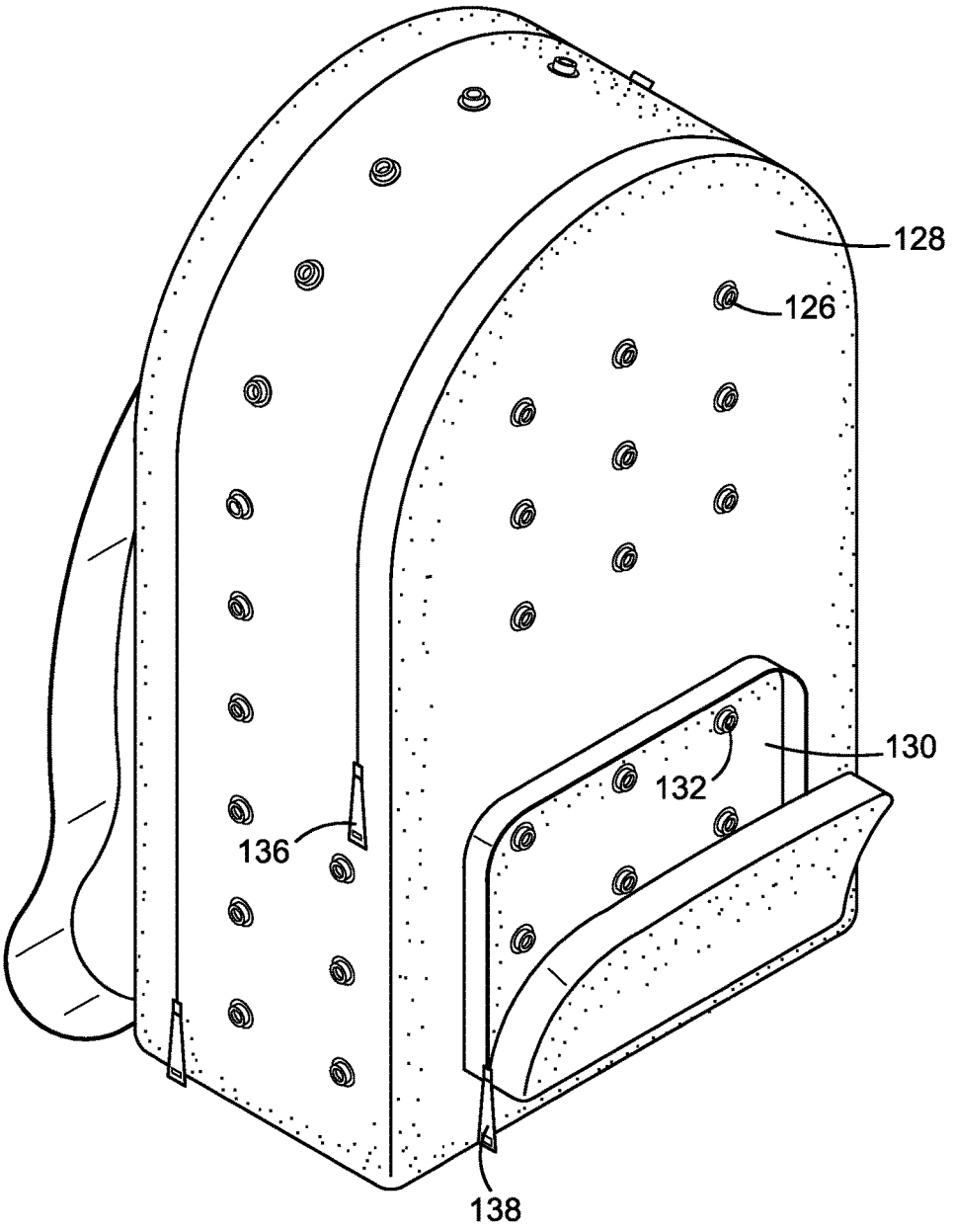
FIG. 10 illustrates a preferred embodiment of a second adjustable storage system or second item being a backpack with an attachment attached to said backpack.

FIG. 10 illustrates a preferred embodiment of backpack 128 having a plurality of connectors 126 on the exterior of the pack. The illustrated backpack can be considered to be an example of a second adjustable storage system or second item in an adjustable storage system as set forth in the claims. The backpack features an external compartment 130; and zipper closure 138. Within compartment 130, is a plurality of connectors 132 for attachments. The connectors are arranged such that attachments can be placed on and in the backpack, and interchanged with attachments and/or secondary article of manufacture, such as a belt, jewelry roll, tote bag, purse, or similar article, that are compatible with the connectors. The pack has an internal larger pocket (not shown) that is closed by zipper 136. The pack can be manufactured to have snap attachments or other connectors in the pocket closed by zipper 136. These connectors can also be made such that they are interchangeable with other articles and/or manufacturers or such that attachments are interchangeable with the exterior and interior of the backpack 128. Exterior pocket 130 can also be a layerable attachment as attached to backpack 128. The attachment 130 could be removed from backpack 128 and attached to another item.

Figure 11:
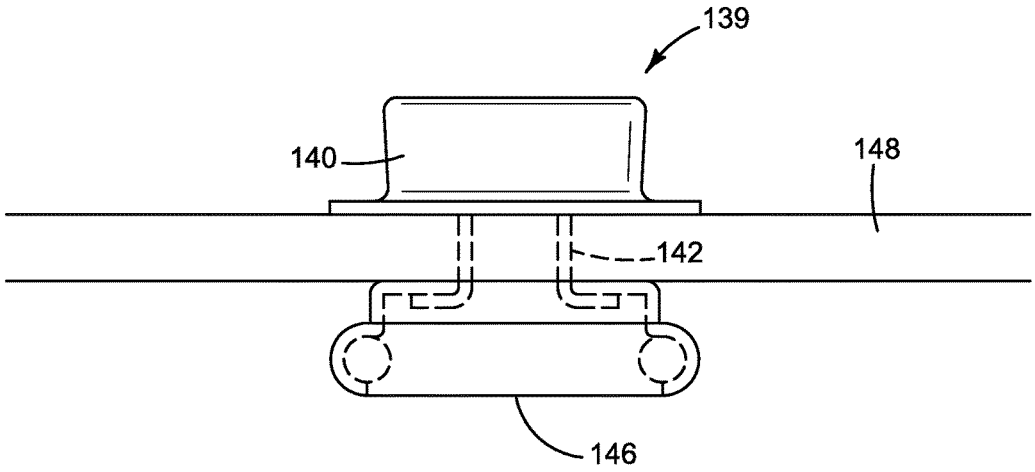
FIG. 11 illustrates a preferred embodiment of a stackable connector.

FIG. 11 illustrates a preferred attachment mechanism for a preferred embodiment of the current invention. The snap attachment 139 has a female portion 146 and a male stud portion 142, 140. The male portion 142 of attachment 139 inserts through the article 148 such that it inserts within the female attachment 146. Subsequently a further male attachment could be used connect to either the female end 140 or the opposite end 146 of the female attachment. Alternatively, a second stud could be included on either male or female portion illustrated in FIG. 11. This allows for a layering of attachments in which multiple attachments can be layered upon each other. These attachments can be made such that the snap attachments are the same in a variety of articles of clothing and/or manufacture, thus providing an interchangeable system of articles that allow for the interchangeability of the articles.

While certain exemplary embodiments are shown in the Figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. An adjustable storage system, said system comprising:

a first item, wherein said first item comprising a back, said back comprising a plurality of connectors for releasably connecting an attachment;

a plurality of attachments configured to attach with said connectors to said back, wherein said attachments are configured to releasably secure said attachment to said back, wherein said attachments and said connectors are configured such that said attachments are interchangeable with said connectors, wherein said attachments are configured to store an object; and a second item, wherein said second item comprises a plurality of connectors for releasably connecting said attachments to said second item, wherein said connectors of said first item and said connectors of said second item are configured such that said attachments are configured to be interchangeable between said connectors of said first item and said connectors of said second item, wherein said first and said second items comprise non-identical items and are not physically connected.

2. The adjustable storage system of claim 1, wherein said back comprises an open position and a closed position, wherein said back is configured to be moved from said open position to said closed position.

3. The adjustable storage system of claim 2, wherein said back comprises a securing mechanism with said connectors for releasably securing said system in said closed position.

4. The adjustable storage system of claim 1, wherein said back is comprised of material selected from the group consisting of leather, cotton, duck, waxed cotton, nylon, neoprene, polyester, rubber coded tech fabrics, waterproof laminates, microfiber materials, felted materials, netting materials, elastane materials, aluminum, stainless steel, silver, bronze and gold.

5. The adjustable storage system of claim 1, wherein said connectors are selected from the group consisting of snaps, buttons, rivets, turn fasteners, one way lift fasteners, screws, buckles, hooks, clips, grommets, rings, ties, laces, hook and loop fabric, and elastic.

6. The adjustable storage system of claim 1, wherein said attachments are selected from the group consisting of sleeves and socks for individual pieces, boxes, rolls, holders, straps, pouches, pockets, belts, bags, handles and envelopes.

7. The adjustable storage system of claim 1, wherein said attachments are configured such that said attachments are configured to be attached to said storage system in multiple layers.

8. The adjustable storage system of claim 7, wherein said attachments are configured such that a first attachment is configured to connect to a second attachment, wherein said first attachment and said second attachment are configured to attach to said back as multiple layers.

9. The adjustable storage system of claim 8, wherein said connectors of said first attachment are configured to attach to said back and to said second attachment to provide said multiple layers.

10. An adjustable interchangeable storage system, wherein said system comprises the following:

a first item, wherein said first item comprises a series of connectors, wherein said connectors are configured such that a plurality of attachments can be attached to said first item;

a second item, wherein said second item comprises a series of connectors, wherein said connectors are configured such that said plurality of attachments can be attached to said second item;

wherein said first item and said second item are selected from the group consisting of hand bags, tote bags, back packs, jewelry rolls, jewelry storage systems, shoulder holsters, luggage, belts, and messenger bags;

wherein said attachments are configured to store an object;

wherein said first item and said second item and said attachments are configured such that said attachments are interchangeable between said first item and said second item and can be attached to each of said first item and said second item in a plurality of locations;

wherein said first and said second items comprise non-identical items and are not physically connected.

11. The adjustable storage system of claim 10, wherein said connectors comprise a series of snaps, wherein said connector comprises a snap connector, wherein said connectors comprise a first row of connectors and a second row of connectors, wherein said first row of connectors and said second row of connectors comprise a row length and a row width, wherein said connectors are separated by a length and a width, wherein said connectors on said first item and said second item and said connectors on said attachment are configured such that said attachments are attachable to said first item and said second item.

12. The storage system of claim 11, wherein said connectors on said attachment comprise at least two connectors, wherein said connectors on said attachment are configured such that said two connectors on said accessory are configured to simultaneously be connected to connectors on said first item; wherein said connectors on said attachment are configured such that said two connectors on said attachment are configured to simultaneously be connected to connectors on said second item.

13. The storage system of claim 10, wherein said first item and said second item are configured to attach to one another.

* * * * *